US011381009B2

(12) United States Patent
Yasui et al.

(10) Patent No.: US 11,381,009 B2
(45) Date of Patent: Jul. 5, 2022

(54) CONTACT AND CONNECTOR

(71) Applicant: Tyco Electronics Japan G.K., Kawasaki (JP)

(72) Inventors: Tatsuo Yasui, Kawasaki (JP); Hiroaki Kikuchi, Kawasaki (JP); Masaaki Iwasaki, Kawasaki (JP); Chihiro Hikage, Kawasaki (JP)

(73) Assignee: Tyco Electronics Japan G. K., Kawasaki (JP)

( * ) Notice: Subject to any disclaimer, the term of this patent is extended or adjusted under 35 U.S.C. 154(b) by 0 days.

(21) Appl. No.: 17/101,679

(22) Filed: Nov. 23, 2020

(65) Prior Publication Data

US 2021/0159617 A1 May 27, 2021

(30) Foreign Application Priority Data

Nov. 27, 2019 (JP) ..... JP2019-214024

(51) Int. Cl.

| | |
|---|---|
| ***H01R 4/24*** | (2018.01) |
| ***H01R 4/2452*** | (2018.01) |
| ***H01R 13/11*** | (2006.01) |
| ***H01R 13/41*** | (2006.01) |
| ***H01R 4/02*** | (2006.01) |

(52) U.S. Cl.
CPC ..... *H01R 4/2452* (2018.01); *H01R 4/029* (2013.01); *H01R 13/11* (2013.01); *H01R 13/41* (2013.01)

(58) Field of Classification Search
None
See application file for complete search history.

(56) References Cited

U.S. PATENT DOCUMENTS 4,315,663 A * 2/1982 Olsson ..... H01R 4/2462 439/398

FOREIGN PATENT DOCUMENTS

JP 6-5316 B2 1/1994

* cited by examiner

*Primary Examiner* — Ross N Gushi
(74) *Attorney, Agent, or Firm* — Barley Snyder

(57) ABSTRACT

A contact includes a base portion, a cold-weld portion extending upward from the base portion and having a cold-weld slot into which an electric wire is configured to be cold-welded, a trailing portion extending downward by being folded back downward from an upper end of the cold-weld portion, and a contact portion extending from a lower end of the trailing portion. The trailing portion has a press-fitted portion below the cold-weld slot that is press-fitted into the housing. The contact portion makes contact with a mating contact by receiving the mating contact in a space between the contact portion and the base portion.

14 Claims, 5 Drawing Sheets

CONTACT AND CONNECTOR

CROSS-REFERENCE TO RELATED APPLICATION

This application claims the benefit of the filing date under 35 U.S.C. § 119(a)-(d) of Japanese Patent Application No. 2019-214024, filed on Nov. 27, 2019.

FIELD OF THE INVENTION

The present invention relates to a contact and, more particularly, to a contact having a cold-weld portion into which an electric wire is cold-welded.

BACKGROUND

A connector conventionally can include a contact having a cold-weld portion. For example, Japanese Patent No. 6-5316A discloses a contact having a cold-weld portion provided above a base portion and a contact portion, provided below the base portion, that makes contact with a mating contact. The cold-weld portion has a cold-weld slot formed in the center between the right and the left. The cold-weld slot receives a covered electric wire, cuts off an outer jacket of the covered electric wire, and makes contact with a core wire of the covered electric wire. The contact portion makes contact with an inserted male mating contact by receiving the mating contact into a space between the contact portion and the base portion. This contact has press-fitted portions, provided on both the right and left sides of the cold-weld portion, that are press-fitted into a housing. When this contact is incorporated into the housing, the press-fitted portions are press-fitted into the housing, so that this contact is fixed in the housing.

Recent demands for reductions in size and weight have reached connectors including the above types of contacts. For this reason, there have been further reductions in size and thickness of the contacts, so that it has become easier and easier for them to bend. In the case of a contact structured as described in JP 6-5316A, when the contact is press-fitted into the housing, the press-fitted portions receive reaction forces from the housing, so that a force acts on the cold-weld portion in such a direction as to reduce the width of the cold-weld slot. For this reason, when the contact easily bends under the effect of reductions in size and thickness, the press-fitted portions are not securely press-fitted into the housing, with the result that an intended effect might not be brought about.

Further, when the mating contact has been received into the space between the contact portion and the base portion, the contact portion elastically deforms. In the case of a contact structured as described in JP 6-5316A, the press-fitted portions are located on the right and left sides of the cold-weld portion. For this reason, the effect of the elastic deformation of the contact portion by the insertion of the mating contact might reach the cold-weld portion. When the contact easily bends under the effect of reductions in size and thickness, the cold-weld portion is greatly affected, with the result that there might be a fluctuation in contact pressure of the cold-weld portion against the core wire.

SUMMARY

A contact includes a base portion, a cold-weld portion extending upward from the base portion and having a cold-weld slot into which an electric wire is configured to be cold-welded, a trailing portion extending downward by being folded back downward from an upper end of the cold-weld portion, and a contact portion extending from a lower end of the trailing portion. The trailing portion has a press-fitted portion below the cold-weld slot that is press-fitted into the housing. The contact portion makes contact with a mating contact by receiving the mating contact in a space between the contact portion and the base portion.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
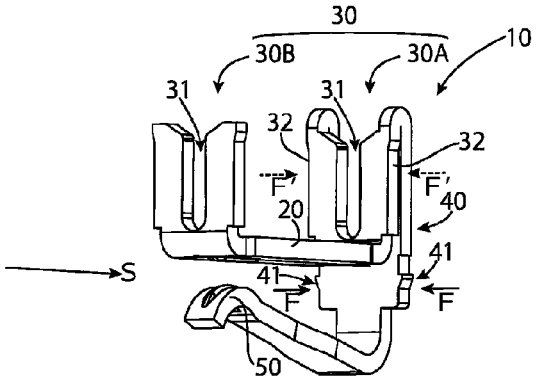
FIG. 1 is a perspective view of a contact according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. Furthermore, several aspects of the embodiments may form—individually or in different combinations—solutions according to the present invention. The following described embodiments thus can be considered either alone or in an arbitrary combination thereof.

A contact 10 according to an embodiment is shown in FIG. 1. The contact 10, in an embodiment, is formed by stamping and forming one flat sheet of metal. The contact 10 has a base portion 20, a cold-weld portion 30, a trailing portion 40, and a contact portion 50.

In the embodiment shown in FIG. 1, the base portion 20 is in the shape of a flat plate that extends horizontally.

As shown in FIG. 1, the cold-weld portion 30 extends upward from the base portion 20. The cold-weld portion 30 has a cold-weld slot 31 onto which a covered electric wire 90 (see FIG. 5) is cold-welded. Fitting the covered electric wire 90 into this cold-weld portion 30 causes an outer jacket of the covered electric wire 90 to be cut off at both edges of the cold-weld slot 31, allowing electrical continuity between a core wire inside the outer jacket and the contact 10.

The cold-weld portion 30 has a first cold-weld portion 30A and a second cold-weld portion 30B provided at a front end and a rear end, respectively, of the base portion 20 in a direction of insertion of a mating contact 80 (see FIG. 5) indicated by an arrow S. Cold-welding the covered electric wire 90 at two places, namely the first cold-weld portion 30A and the second cold-weld portion 30B, improves reliability of the continuity between the core wire and the contact 10.

The trailing portion 40, as shown in FIG. 1, extends downward by being folded back downward at an upper end of the cold-weld portion 30 or, specifically, at an upper end of the first cold-weld portion 30A provided at the front end in the direction of insertion S. The trailing portion 40 has a press-fitted portion 41 that is press-fitted into a housing. The press-fitted portion 41 is located below the cold-weld slot 31 and includes a pair of press-fitted portions 41 provided on both the right and left sides of the trailing portion 40.

The cold-weld slot 31 is not formed in a place where this press-fitted portion 41 is provided, as shown in FIG. 1, and there is no space such as the cold-weld slot 31 between the right and left press-fitted portions 41. For this reason, even in the presence of the application of forces in such directions as to move the right and left press-fitted portions 41 toward each other (i.e. in directions indicated by arrows F), the distance between the right and left press-fitted portions 41 is maintained. On the other hand, the application of forces to the cold-weld portion 30, which has the cold-weld slot 31 formed therein, in directions indicated by arrows F' causes the cold-weld slot 31 to bend inward, so that the distance between right and left edges 32 of the cold-weld portion 30 becomes shorter.

In known contacts, the press-fitted portions are formed in locations beside the cold-weld slot 31 as indicated by the arrows F'. For this reason, when the cold-weld slot 31 bends inward, the press-fitted portions move in a direction away from a wall of the housing, so that there is a risk that sufficient press fitting and, by extension, retention of the contact may not be accomplished.

In the present invention, there is no space such as the cold-weld slot 31 between the right and left press-fitted portions 41, so that even when the press-fitted portions 41 receive strong reaction forces from a wall 61 of a housing 60, the press-fitted portions 41 can withstand the strong reactive forces. This allows sufficient press fitting.

As shown in FIG. 1, the contact portion 50 extends in a cantilever form from a lower end of the trailing portion 40. In the shown embodiment, the press-fitted portion 41 is provided midway between the cold-weld portion 30 and the contact portion 50. The contact portion 50 makes contact with an inserted male mating contact 81 for electrical continuity by receiving the mating contact 81 into a space between the contact portion 50 and the base portion 20, as described in greater detail below.

Figure 2:
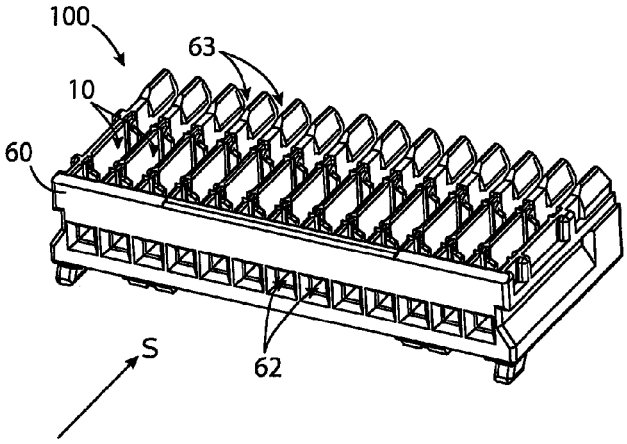
FIG. 2 is a perspective view of a connector according to an embodiment.
Figure 3:
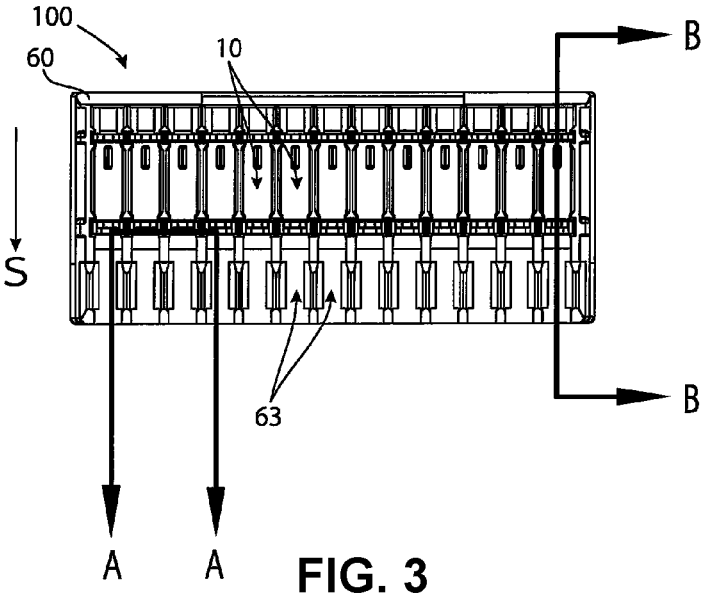
FIG. 3 is a top view of the connector.

A connector 100 according to an embodiment, as shown in FIGS. 2 and 3, includes a housing 60 and a plurality of (in the case of the example illustrated in FIG. 2, thirteen) contacts 10 fitted in the housing 60. It should be noted that although the connector 100 described here includes thirteen contacts 10, the number of contacts 10 may be any number of 1 or larger. An arrow S shown in FIGS. 2 and 3 is oriented in the same direction as the arrow S shown in FIG. 1. That is, the housing 60 is fitted with the plurality of contacts 10 so that the arrow S of FIG. 1 and the arrow S of FIGS. 2 and 3 are oriented in the same direction.

Figure 4A:
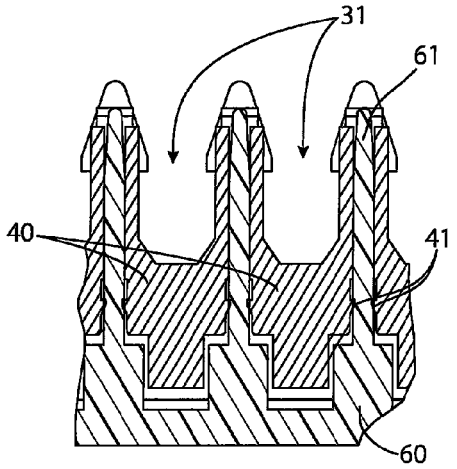
FIG. 4A is an enlarged sectional side view of the connector taken along line A-A in FIG. 3.

As shown in FIG. 4A, fitting each contact 10 into the housing 60 causes the press-fitted portion 41 to be press-fitted into the wall 61 of the housing 60. This causes each contact 10 to be fixed in its predetermined location within the housing 60.

Figure 4B:
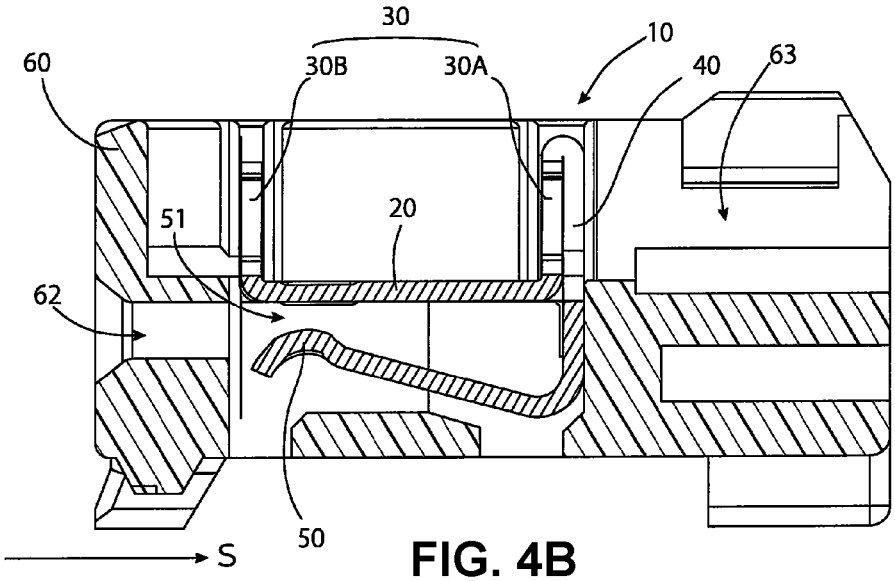
FIG. 4B is an enlarged sectional side view of the connector taken along line B-B in FIG. 3.

The housing 60 has an insertion opening 62, formed in a location corresponding to each contact 10, into which a mating contact 81 (see FIG. 5) is inserted, as shown in FIGS. 2, 3, and 4B. As shown in FIG. 4B, the insertion opening 62 is formed in a location between the base portion 20 and the contact portion 50 of the contact 10 that communicates with a receptacle 51 of the mating contact 81.

The housing 60 has a holding groove 63 corresponding to each contact 10, as shown in FIGS. 2, 3, and 4B. The covered electric wire 90 has an end cold-welded onto the cold-weld portion 30 of the contact 10, and a portion of the covered electric wire 90 that extends from the cold-welded end is held in the holding groove 63 of the housing 60. Note, however, that FIGS. 2-4B omit illustration of the covered electric wire 90.

Figure 5A:
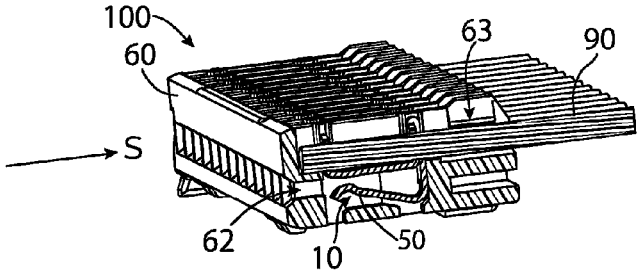
FIG. 5A is a sectional perspective view of the connector with a covered electric wire.
Figure 5B:
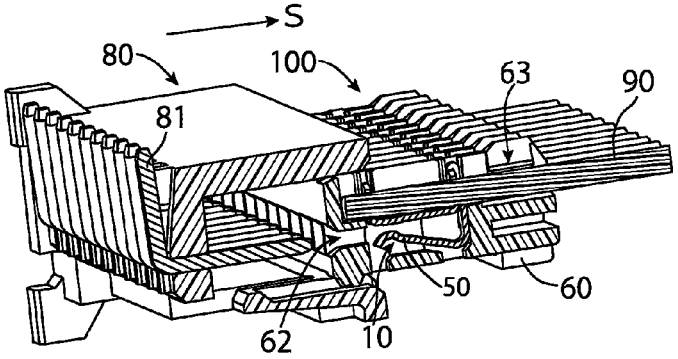
FIG. 5B is a sectional perspective view of the connector with a mating connector prior to mating.
Figure 5C:
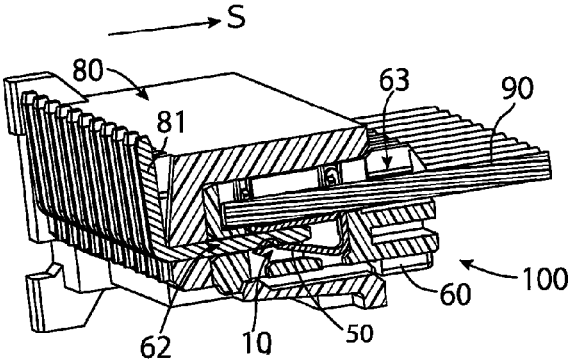
FIG. 5C is a sectional perspective view of the connector mated with the mating connector.

The connector 100 is shown with the covered electric wire 90 in FIGS. 5A-5C. The covered electric wire 90 illustrated here is illustrated as a single entity without distinction between the outer jacket and the core wire. FIGS. 5B and 5B show a mating connector 80 matable with the connector 100.

As shown in FIG. 5A, the covered electric wire 90 has an end cold-welded onto the cold-weld portion 30 of the contact 10, and a portion of the covered electric wire 90 that extends from the cold-welded end is held in the holding groove 63 of the housing 60.

The mating connector 80 is shown prior to mating with the connector 100 in FIG. 5B and is shown mated with the connector 100 in FIG. 5C. The mating connector 80 includes as many male mating contacts 81 as the contacts 10 of the connector 100. Mating the mating connector 80 with the connector 100 causes each mating contact 81 to be inserted into the connector 100 through the corresponding insertion opening 62. Moreover, the mating contact 81 thus inserted is placed between the contact portion 50 and the base portion 20 of the contact 10 of this connector 100 to electrically conduct with the contact 10.

In inserting the mating contact 81, the contact portion 50 elastically bends. Note, however, that the effect of bending of the contact portion 50 is blocked in a portion of the trailing portion 40 where the press-fitted portion 41 is formed, so that the effect on the cold-weld portion 30 can be ignored. Accordingly, stable conduction between the cold-weld portion 30 and the core wire of the covered electric wire 90 is maintained even when the mating contact 81 is inserted.

What is claimed is:

1. A contact, comprising:

a base portion;

a cold-weld portion extending upward from the base portion and having a cold-weld slot into which an electric wire is configured to be cold-welded;

a trailing portion extending downward by being folded back downward from an upper end of the cold-weld portion, the trailing portion having a press-fitted portion below the cold-weld slot that is press-fitted into a housing; and a contact portion extending from a lower end of the trailing portion and making contact with a mating contact by receiving the mating contact in a space between the contact portion and the base portion.

2. The contact of claim 1, wherein the cold-weld portion has a first cold-weld portion at a front end of the base portion and a second cold-weld portion at a rear end of the base portion in a direction of insertion of the mating contact.

3. The contact of claim 2, wherein the trailing portion extends downward by being folded back downward from an upper end of the first cold-weld portion.

4. A connector, comprising:

a housing; and a contact including a base portion, a cold-weld portion extending upward from the base portion and having a cold-weld slot into which an electric wire is configured to be cold-welded, a trailing portion extending downward by being folded back downward from an upper end of the cold-weld portion, the trailing portion having a press-fitted portion below the cold-weld slot that is press-fitted into the housing, and a contact portion extending from a lower end of the trailing portion and making contact with a mating contact by receiving the mating contact in a space between the contact portion and the base portion.

5. The connector of claim 4, wherein the housing has an insertion opening aligned with the space between the contact portion and the base portion, the insertion opening receiving the mating contact.

6. The connector of claim 4, wherein the housing has a holding groove, a portion of the electric wire that extends from the cold-weld slot is held in the holding groove.

7. The connector of claim 4, wherein the press-fitted portion of the trailing portion is press-fit into a wall of the housing.

8. A contact, comprising:

a base portion;

a cold-weld portion extending from the base portion and having a cold-weld slot into which an electric wire is configured to be cold-welded;

a trailing portion folded back and extending from an upper end of the cold-weld portion, the trailing portion having a press-fitted portion that is not aligned with the cold-weld slot; and a contact portion extending from a lower end of the trailing portion and making contact with a mating contact by receiving the mating contact in a space between the contact portion and the base portion.

9. The contact of claim 8, wherein the press-fitted portion includes a right press-fitted portion and a left press-fitted portion.

10. The contact of claim 9, wherein the trailing portion does not have a space between the right press-fitted portion and the left press-fitted portion.

11. The contact of claim 9, wherein the cold-weld slot is not positioned between the right press-fitted portion and the left press-fitted portion.

12. The contact of claim 8, wherein the press-fitted portion is positioned below the cold-weld slot.

13. The contact of claim 8, wherein the cold-weld portion has a first cold-weld portion at a front end of the base portion and a second cold-weld portion at a rear end of the base portion in a direction of insertion of the mating contact.

14. The contact of claim 13, wherein the trailing portion extends downward by being folded back downward from an upper end of the first cold-weld portion.

* * * * *